United States Patent [19]

Lages

[11] 3,969,259

[45] July 13, 1976

[54] TRANSPARENT SOAP BAR

[75] Inventor: Robert E. Lages, Paramus, N.J.

[73] Assignee: Lever Brothers Company, New York, N.Y.

[22] Filed: Mar. 18, 1974

[21] Appl. No.: 452,179

[52] U.S. Cl. ..... 252/107; 252/108; 252/122; 252/132; 252/522; 424/343; 424/347

[51] Int. Cl.[2] ..... C11D 9/44; C11D 9/50; C11D 13/08

[58] Field of Search ..... 252/106, 107, 108, 122, 252/132, 127, 522, 368, 363.5; 424/347

[56] References Cited

UNITED STATES PATENTS

| | | | |
|---|---|---|---|
| 2,251,935 | 8/1941 | Hartung | 252/107 |
| 2,970,116 | 1/1961 | Kelly et al. | 252/368 |
| 3,023,144 | 2/1962 | Greathouse et al. | 252/106 X |
| 3,155,624 | 11/1964 | Kelly | 252/122 |
| 3,274,119 | 9/1966 | Goldwasser et al. | 252/368 |
| 3,835,057 | 9/1974 | Cheng et al. | 252/107 |
| 3,839,232 | 10/1974 | Ohloff et al. | 252/522 |
| 3,852,471 | 12/1974 | Paulus et al. | 424/334 |

FOREIGN PATENTS OR APPLICATIONS

| | | |
|---|---|---|
| 23,117 | 11/1911 | United Kingdom |
| 319,804 | 9/1929 | United Kingdom |
| 366,870 | 2/1932 | United Kingdom |

*Primary Examiner*—P.E. Willis, Jr.
*Attorney, Agent, or Firm*—James J. Farrell; Kenneth F. Dusyn; Melvin H. Kurtz

[57] ABSTRACT

The germicide, 2,4,4′-trichloro-2′-hydroxy diphenyl ether may be incorporated into a milled transparent soap with substantially no opacifying effect provided that the germicide is first dissolved in perfume material and the resulting solution added to the soap at any point between the drying of the soap chips and the extrusion of the plodded soap.

4 Claims, 1 Drawing Figure

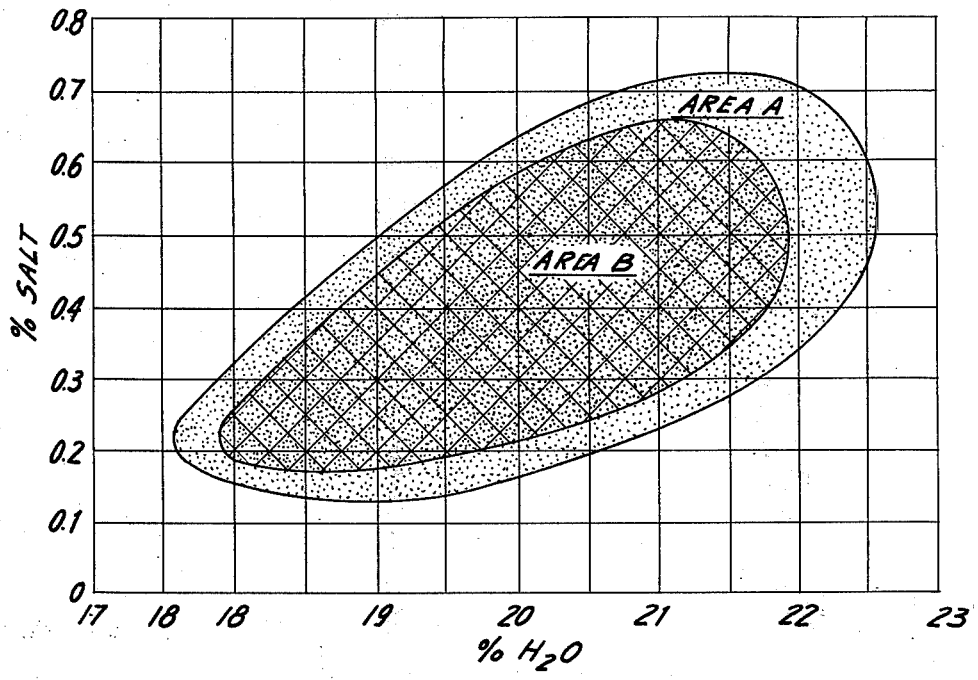
0.8
0.7
0.6
0.5
0.4
0.3
0.2
0.1
0
% SALT
AREA A
AREA B
17
18
18
19
20
21
22
23
% $H_2O$

TRANSPARENT SOAP BAR

BACKGROUND OF THE INVENTION

1. Field of the Invention

Germicidal soap bars of the conventional opaque milled type are well known. Attempts however to extend the field of germicidal bars to germicidal transparent bars by a process of adding powdered germicide at the chip-mixing step have been unsuccessful, resulting in opaque bars, particularly at the more useful levels, e.g., above about 1%, or when the proportion of germicide is low, e.g., about 0.15%, in specks of undispersed germicide in an otherwise transparent bar. This property of insolubility in a soap mass during processing to a transparent state is shared by the well-known phenolic germicides heretofore disclosed as useful in the conventional milled soap bars, for example, 2,2'methylenebis(3,4,6-trichlorophenol), 2,4,4'-trichlorocarbanilide, and 3,4';5-tribromosalicylanilide and the 4',5-analogue thereof, as well as 2,4,4'-trichloro-2'-hydroxy diphenyl ether.

2. Description of the Prior Art

Various methods are known for the manufacture of transparent soaps. For example transparent soaps may be made by the old and well-known cold process technique. By this method, tallow, coconut, and castor oil, and sometimes rosin, in the melted state are place in a vessel and stirred with a calculated quantity of sodium hydroxide solution in the presence of alcohol, glycerine, or sugar, or mixtures of these. The resulting soap is allowed to stand for some time whereupon saponification is complete and the soap is transparent.

In another method well known in the art, sodium soap of the desired fat formula is dried and shredded, and the shreds are dissolved in alcohol. Alternatively, the fats may be treated with alcoholic caustic soda. Insoluble matter, such as sodium carbonate, is separated from the resulting soap solution, the bulk of the alcohol is distilled off, and the gelatinous residue run into molds. Upon standing, the soap loses some of the alcohol and becomes transparent, especially if stored at about 35°C.

Methods for making transparent soap are set forth in U.S. Pat. No. 2,970,116, and in the Lewkowitsch text "Chemical Technology and Analysis of Oils, Fats and Waxes", 6th Ed., Vol. III, (Macmillan), pages 216, 343, and 346. In U.S. Pat. No. 1,475,663 there is described in detail a method for making transparent soap involving the addition of alcohol to dissolve the soap, and the subsequent removal of the alcohol by distillation.

British Pat. No. 963,907 describes the enhancement of the antibacterial action of phenolic germicides and certain polyamines.

British Pat. No. 1,227,959 discloses the anti-bacterial activity of a germicide in a soap bar is enhanced if the germicide is first dissolved in one or more of a variety of solvents. The process is stated to be applicable to a translucent bar.

U.S. Pat. No. 3,155,624 discloses a superfatted transparent bar containing a fatty acid and a polyhydric alcohol. The transparency is obtained by the process described in the above-mentioned U.S. Pat. No. 2,970,116.

U.S. Pat. No. 3,485,919 discloses that a variety of alkylphenols promote the antibacterial activity of some of the commonly used antibacterial agents.

U.S. Pat. No. 3,594,322 discloses the presolubilization of brominated salicylanilides in an alkaline solvent such as an alkanolamide, and incorporation of the solution into a liquid detergent composition.

In "Soap and Chemical Specialties", pages 47–50 and 116–122, January, 1968, an article by T. E. Furia and A. G. Schenkel describes the characteristics and properties of 2,4,4'-trichloro-2'-hydroxy diphenyl ether.

SUMMARY OF THE INVENTION

It has now been found that the germicide 2,4,4'-trichloro-2'-hydroxy diphenyl ether is soluble in substantially all of the normally liquid essential perfume substances and blends thereof suitable for use in bar soaps, and that the aforementioned opacity problem can be solved, and a transparent soap obtained, if this germicide is employed and dissolved in the perfume component prior to incorporation in the soap mass. The solution comprising the germicide as solute and the perfume oil or blend as solvent, may be incorporated into the soap at any stage of the processing following the step of drying the neat soap and prior to the extrusion of the plodded soap. The solution will be added at a time sufficiently ahead of the extrusion step to allow thorough mixing throughout the soap mass.

Contrasting with the solubility of 2,4,4'-trichloro-2'-hydroxy diphenyl ether in the usual soap perfume oils, the well-known phenolic germicides, namely 2,2'-methylenebi (3,4,6-trichlorophenol), 2,4,4'trichlorocarbanilide, and 3,4',5-tribromosalicylanilide and the 4',5-analogue thereof, are not soluble in most of the usual soap perfumes to any useful degree. In view of the solubility in perfume oils and excellent germicidal properties, the aforementioned substituted diphenyl ether is an ideal germicide for use in a transparent soap bar. This germicide can reduce and control the characteristic microflora of the human skin including resident and transient staphylococci, diphtheroids, corynebacteria, streptococci, and coliform bacteria, when applied to the skin as a component of a transparent soap bar.

The bacteriostatic properties of 2,4,4'-trichloro-2'-hydroxydiphenyl ether are set forth in the aforementioned Soap and Chemical Specialties article.

It is an object of the present invention to provide a commercially acceptable germicidal transparent soap.

It is another object of the invention to provide a commercially acceptable germicidal transparent soap by a process which utilizes little or no lower alcohol, e.g., 1–3 carbon atoms, solvent.

It is still another object of the invention to provide a solution of 2,4,4'-trichloro-2'-hydroxy diphenyl ether which possesses the triple characteristics of imparting germicidal activity in addition to a pleasing fragrance to a transparent soap and moreover does not adversely affect transparency.

The process of the instant invention may be incorporated into processes for making transparent soaps wherein the soap at all stages of processing contains no lower molecular weight alcohol or contains an amount insufficient for the germicide to dissolve in the solvent-/soap system. When the germicide is added as powder, levels of germicide as low as about 0.15% in the finished soap, are visible in the form of fine specks, not dissolved in the medium, although the surrounding soap is transparent. Accordingly, it is a further object of the invention to provide a process for making a transparent germicidal soap wherein the transparency is substantially uniform.

DETAILED DESCRIPTION OF THE INVENTION

The instant invention finds particular utility in the process for preparing the transparent soap bars described in U.S. Pat. No. 2,970,116, assigned to the instant assignee, and incorporated herein by reference.

In this patent a graph identical with the instant drawing is presented.

This drawing in general illustrates the area "B" the relationship of salt and water which permits the production of a transparent soap bar as freshly plodded. Area "A", outside of area "B", illustrates a relationship of salt and water which results in transparent soap after a reasonable period of aging. In the aforementioned patent, the process which is described involves firstly the drying of molten neat kettle soap from a moisture content of about 28% to about 34% down to a lower level, for example 19–20%, consistent with the moisture level desired in the final soap bar. The dried soap, still in the molten state, is solidified, preferably on a chill roll to form flakes. The flakes are placed in a mixer, then optional ingredients such as colorants are added, and the mixing operation conducted in such a manner as to permit a shearing and working of the soap mass to the extent that the temperature of the soap mass, starting at about 80°–85°F, rises several degrees, but not above 110°F. The water and salt content are adjusted within the limits required for transparency, then the soap is milled, during which any portion of the soap not already transparent becomes transparent, followed by plodding, extrusion, and stamping. In the process disclosed in this patent, the starting material need not be neat kettle soap but can be simply a soap mass, however prepared, which is capable of having its moisture and salt contents adjusted to the levels required by transparency. Further, the patent teaches that in the mixing step, the mechanical energy of the moving mixer blades is taken up by the soap in the form of heat energy, although transparency can be obtained without any mixing step at all, for example, during the milling step, or by the refining step described in U.S. Pat. No. 2,005,333.

The benefits of the present invention may also be obtained in transparent soaps made by the semi-boiled process wherein the oils and fats to be used are mixed together, heated to about 140°F, caustic soda solution added, and stirred until the mass reaches a desired consistency. Following this, a transparency aid, such as sugar solution, sorbitol, glycerine, or mixtures thereof are added and the resulting mixture thoroughly mixed at a temperature of about 160°F whereupon perfume is added. The hot soap is run into the well-known soap frame, allowed to solidify, then slabbled, cut and stamped.

In accordance with the present invention, transparent soaps containing little or no lower alcohol, e.g., ethanol, may have germicidal activity imparted thereto without adversely affecting transparency.

More specifically, the instant invention provides an improved method for attaining germicidal activity in a transparent soap bar in a process for preparing a transparent soap bar wherein said transparency is achieved by a transparency aid selected from the group consisting of sucrose, sorbitol, glycerol, pentaerythritol, potassium soap or mixtures thereof, or by the conversion of mechanical energy to heat energy, and wherein said soap, however prepared, is chipped, mixed, plodded extruded, and stamped, the improvement comprising rendering said soap germicidal by the steps of:

i. preparing a visually clear solution of 1 part by weight of the germicide 2,4,4′-trichloro-2′-hydroxy diphenyl ether in about 0.7 to about 25 parts by weight of a liquid, pleasantly odorous substance, and ii. incorporating said visually clear solution into said soap prior to the completion of the plodding thereof, the proportions of said 2,4,4′-trichloro-2′-hydroxy diphenyl ether being from about 0.15% to about 4%, basis of said transparent soap bar.

As applied to a transparent soap bar prepared by converting mechanical energy to heat energy, the instant invention provides an improved method for attaining germicidal activity in a transparent soap bar in a process for preparing a transparent soap bar having a translucency voltage of no greater than about 35, said process comprising working below about 110°F. a toilet soap mass having a very low level of free alkali wherein the mechanical energy is converted into heat energy by working to an extent great enough to cause the mixture to rise in temperature to within a range of from about 100°F to about 110°F, the moisture and water-soluble, soap-compatible, alkali metal salt content having been adjusted prior to the end of the working step to lie within the combined areas "A" and "B" of the drawing hereof in the finished bar, and plodding the soap mass into bar form, the improvement comprising the steps of:

i. preparing a visually clear solution of 1 part by weight of 2,4,4′-trichloro-2′-hydroxy diphenyl ether in about 0.5 to about 25 parts by weight of a soap-compatible, liquid, pleasantly odorous solvent for said ether, and ii. incorporating said visually clear solution into said soap mass prior to the completion of the working thereof, the proportions of said 2,4,4′-trichloro-2′-hydroxy diphenyl ether being from about 0.15% to about 6%, and the proportion of said solvent being from about 0.15% to about 4%, basis of said transparent soap bar.

By the expression "very low level of free alkali" as used herein is meant the small percentages permissible in a good quality toilet soap bar, the range being well known to those skilled in the art. Normally the range of free alkali regarded as a very low level will vary from about 0.025% to about 0.04%, calculated as $Na_2O$. In the case of a superfatted bar containing free fatty acid, such as described in U.S. Pat. No. 3,155,624, there will be substantially no free alkali in the finished bar. In view of the foregoing, the free alkali content of the finished bars within the present invention may vary from zero percent to about 0.04%, calculated as $Na_2O$.

Solutions having concentrations of germicide useful in accordance with the invention are prepared by dissolving about 1 part by weight of 2,4,4′-trichloro-2′-hydroxy diphenyl ether in about 0.7 part to about 25 parts by weight of a normally liquid perfume substance suitable for use in bar soaps or in cosmetic products formulated for application to the skin. The proportion of germicide relative to the perfume solvent may be selected as desired, consistent with the solvent power of the perfume substance. Solutions thus prepared are capable of imparting germicidal activity and a pleasing fragrance to a transparent soap when incorporated as described herein, with no adverse effect on the transparency of the soap.

Specific essential oils suitable for use in accordance with the instant invention are:

diphenyl ether
phenylether alcohol
geraniol
citronellol
linalool
heptaldehyde
benzaldehyde
phenylacetaldehyde
linalyl acetate
citral
methyl heptyne carbonate
ylang-ylang
sandalwood
cananga
terpineol
alpha-pinene
perillyl alcohol
beta-pinene
trans-carveol
pulegone
d-limonene
alpha-ionone
beta-ionone
irone
oil of thyme
Geranium Algerian
clove bud
lavandin absolute
balsam Peru
benzyl alcohol
benzyl acetate
fenchone
isoeugenol
safrol
peppermint
lavender
bergamot
lemongrass The following blends are also useful:

BLEND A

| | |
|---|---|
| Citronella | 31% |
| Verbena | 15% |
| Lavender | 24% |
| Caraway | 24% |
| Cassia | 6% |
| | 100% |

BLEND B

| | |
|---|---|
| Oil ylang-ylang | 1% |
| Oil cananga | 2% |
| Coumarin | 3% |
| Heliotropin | 2% |
| Oil Geranium | 3% |
| Oil citronella | 1% |
| Oil Cedarwood | 1% |
| Terpineol | 86.9% |
| Musk Ambrette | 0.1% |
| | 100.0% |

BLEND C

| | |
|---|---|
| Bergamot | 23% |
| Oil lavender | 22% |
| Oil cedarwood | 30% |
| Oil ylang-ylang | 3% |
| Alpha-Ionone | 9% |
| Courmarin | 3% |
| Vanillin | 2% |
| Musk Ambrette | 0.2% |
| Methyl heptyne carbonate | 7.8% |
| | 100.0% |

BLEND D

-continued

| | |
|---|---|
| Linalool | 59% |
| Irone | 5% |
| Cinnamic aldehyde | 20% |
| Linalyl acetate | 10% |
| Benzaldehyde | 5% |
| Safrol | 1% |
| | 100% |

Of particular value are the essential oils within the group phenylethyl alcohol, dephenyl ether, geraniol, linalyl acetate, irone, bergamot, lavandin, linalool, terpineol, and mixtures thereof.

Persons skilled in the soap art, particularly in view of the disclosures herein, will be aware of the nature (e.g., source of fat, molecular distribution, degree of unsaturation, etc.) of the soaps with which the present invention is concerned. The word "soap" is used herein in its popular meaning, i.e., the alkali-metal salt of an aliphatic alkane- or alkenemonocarboxylic acid. Useful soaps are the salts of fatty acids having about 12 to about 22 carbon atoms, with small proportions of fatty acids having 6–10 carbon atoms when coconut or other tropical nut triglyceride oils are included in the fat charge from which at least a portion of the soap is derived. Soaps having the fatty acid distribution of coconut or other tropical nut oils may provide the lower end of the broad molecular weight range (i.e., $C_6$–$C_{14}$) while soaps having the molecular weight distribution of the fatty acids of peanut oil, rapeseed oil, or tallow, may provide the upper end. It is preferred to employ soaps prepared from 70–80% tallow and 20–30% coconut oil.

It will be understood that the coconut oil soap may be replaced by soap prepared from other tropical nuts or "high lauric" oils, that is, oils or fats wherein at least 50% of the total fatty acids are composed of lauric and myristic acids. These oils are generally exemplified by the tropical nut oils of the coconut oil class, such as palm kernel oil, babassu oil, ouricuri oil, tucum oil, cohune oil, murumuru oil, jaboty kernel oil, khakan kernel oil, dika nut oil, and for present purposes ucuhuba butter, a vegetable triglyceride rich in myristic acid esters.

As employed herein, the term "neat soap" refers to the washed, grained, and settled soap in its final stage as made by the kettle-boiling process, and having a water content of about 30%.

Except where otherwise set forth, the cation of the soap employed in the Examples herein is sodium. Potassium may comprise a part of the cation, as mentioned in the aforesaid U.S. Pat. No. 2,970,116. Processes for the production of transparent soap are discussed by F. W. Wells in "Soap and Chemical Specialties", Vol. XXXI, No. 6 and 7, June and July 1955. As mentioned in these articles, a transparent soap should be sufficently transparent to permit boldface type of about 14 point size to be read easily through a section of thickness of a quarter inch. It is with reference to this standard that the term "transparent" is used in this application in describing the products of the novel process.

Various methods have been used to evaluate the translucency, and more specifically the transparency of soaps. A method for accurately measuring the transparency of a bar of soap is by the use of the following apparatus developed for this purpose. A bar of soap is placed, in a completely darkened room, on top of a cone section surrounding a light source of variable voltage. The cone section has a diameter of ½ inch at the top and 2½ inches at the base, which surrounds the face of the light; the top of the cone section is 9½ inches above the face of the lamp, and the lamp is a microscope lamp with a 120-volt, 15-watt bulb having a blue ground-glass filter. The voltage across the lamp bulb is adjusted until the light from the top of the cone section shines through a bar having a thickness of 2.75 cm. and forms a barely perceptible circular outline. The voltage across the bulb is used as a measure of translucency or transparency, which is independent of color and is termed "Translucency Voltage" or "TV". Thus, the lower the TV is, the more transparent the bar. It is possible to measure readily the TV at other bar thicknesses and interpolate to the standard of 2.75 cm. used herein. This method of determining transparency is believed to be superior to a reflectance test described in the art, because it is relatively unaffected by soap color and gloss and avoids the difficulty of cutting a soap bar to a required thickness of only 1/16 of an inch.

For purposes of comparison, an ordinary milled toilet soap of good quality, even in the absence of pigments such as titanium dioxide which make it opaque, has a TV of greater than than 110, i.e., it is too opaque to be measured on the apparatus described. This is despite the fact that it has the sheen and glossiness which are commonly referred to as the translucency of milled soap, to distinguish it from the dull nature of frame soaps. The products of the present invention, on the other hand, have a TV of 35 or less, generally 30 or less, when freshly made. A bar of soap with a TV of 30 or less meets the standard required to be called transparent. In general, with the soaps of this invention there is an improvement in transparency upon aging of about six days or more, and in particular it is possible to practice our invention and produce a soap which, when fresh, may have a TV of more than 30, even as high as about 35, which soap, when aged, will acquire the transparent properties of a soap of a TV of about 30 or less. The difference between a bar of soap having a TV of 25 and one having a TV of 35 is quite obvious to the unaided eye.

From a consideration of the foregoing definition of transparency as the term is applied to a transparent soap, it will be understood that the term does not encompass translucency, which according to Webster's New International Dictionary, Second Edition, 1952, relates to a substance admitting passage of light, but diffusing it so that objects beyond cannot be clearly distinguished.

The term "pleasantly odorous substance" as used herein refers to a liquid substance having a boiling point of about 150°C or higher, and useful as a component of a perfume blend, or to a perfume blend capable of imparting to soap an odor pleasing to the olfactory senses. It will be understood that acceptance of an odor as "pleasant", based on olfactory reaction, may be dependent upon individual preferences. The word "perfume" as used herein applies to liquid substances suitable for use in soaps or in cosmetics, and which alone or as blends have an aroma generally regarded as pleasant.

The invention will be further understood by reference to the following Examples, which are illustrative, but not limitative, of the scope of the invention.

EXAMPLE 1

Neat soap prepared by the kettle boiling process from a fat charge of about 80% tallow and 20% coconut oil, and containing 0.35% NaCl and 0.04% free alkalinity as $Na_2O$, is run into a crutcher. The soap is crutched for several minutes at a temperature of 205°F, during which the moisture content is adjusted to 30–32%. The soap is then dried to a moisture content of 19–20% by the tubular drying process described in U.S. Pat. No. 2,710,057. The soap at this reduced moisture content is still molten, and is next chilled rapidly on a chill roll to a temperature of 80°–85°F, the soap leaving the chill-roll in the form of chips. A portion of the chips is weighed into a mixture fitted with rotating blades.

Two percent 2,4,4′-trichloro-2′-hydroxy diphenyl ether solubilized in 2% perfume and sufficient NaCl to adjust the finished bar to 0.4% salt content are added. The batch is then mixed for 10 minutes, during which time the soap becomes partly transparent and during which the moisture content is adjusted to 22% by the addition of water. The mixed batch is then milled by four passes over a 3-roll mill, wherein the clearances between the first and second rolls is 0.002 inch, and between the second and third rolls is 0.001 inch. The temperature is controlled so that the soap leaves the third roll at a temperature between 100°F and 106°F, whereupon the soap is uniformly transparent to a high degree. The soap is plodded in a vacuum plodder, then extruded at a temperature of 103°F–106°F. The moisture content of the finished bar is 19.6%. All of the foregoing percentages, other than those representing the fat charge, are expressed as percentages of the finished bar.

EXAMPLE 2

The procedure of Example 1 is followed except that during the crutching step 3% Staybelite Rosin by weight, finished bar basis, is added and saponified with NaOH. The transparency of the finished bar is the same as that of Example 1.

EXAMPLE 3

The procedure of Example 1 is followed except that during the crutching step 3% WW Wood Rosin by weight, finished bar basis, is added and saponified with NaOH. When first made, the bar is less transparent than desired, but improves rapidly and is as uniformly transparent as the bars of Example 1 after 3 days.

EXAMPLE 4

A quantity of molten neat kettle soap containing about 30% water is run into a crutcher to provide 68.65 parts of soap, on a dry basis, having a 4:1 ratio of sodium tallow soap to sodium coconut oil soap. To this is added sufficient coconut fatty acids and 50% aqueous potassium hydroxide solution to provide 4.00 parts of anhydrous potassium coconut oil soap. While crutching, 3.00 parts glycerine, 3.00 parts sorbitol, 1.25 parts salt, 0.04 part butyl hydroxy toluene, and additional coconut oil fatty acids, i.e., 1.25 parts, are added, and the mass crutched for 20 minutes. The cruched mixture is then dried to 17–18% water, using the tubular dryer described in U.S. Pat. No. 2,710,057. The stillmolten soap is chill-rolled into flake, or chip, form. still-molten A weighed quantity of the chips is transferred to a chip mixer fitted with rotating blades. To the chips are added 0.008% colorant, 0.06% Versene, and 1.25% 2,4,4'-trichloro-2'-hydroxy diphenyl ether dissolved in 1.25% perfume oil blend. Next sufficient water is added to bring the water content to 17.492% in the finished bar. The chips are mixed and milled on a 3-roll mill, leaving the third roll at a temperature of 100°–106°F. The soap is then plodded in a vacuum plodder, and extruded at a temperature of 103°–106°F. The soap is uniformly transparent. It is cut into bar lengths and stamped. Percentage figures are by weight of the finished bar.

EXAMPLE 5

Five grams of 2,4,4'-trichloro-2'-hydroxy diphenyl ether are added to five grams of each of the oils listed below at room temperature in small stoppered bottles. The bottles are gently shaken at intervals and observed after 24 hours. The results of the observations are set forth below:

| Perfume Oil | Solubility |
|---|---|
| Thyme | Complete |
| Geranium Algerian | " |
| Terpineol | " |
| Isoeugenol | " |
| Clove Bud | " |
| Linalyl Acetate | " |
| Lavandin Absolute | " |
| Lemongrass | " |
| Balsam Peru | " |
| Linalool | " |
| Geraniol | " |
| Bergamot | " |
| Benzyl alcohol | " |
| Citronellol | " |

One gram of the aforementioned germicide is soluble in 25 grams of Eucalyptus oil or 25 grams of Cedarwood White oil, but insoluble in 25 grams of glycerol.

Having thus described the invention, persons skilled in the art will be aware of modifications within the spirit thereof, and the invention is to be limited only within the scope of the appended claims.

What is claimed is:

1. In a process for preparing a transparent soap bar wherein said transparency is achieved by a transparency aid selected from the group consisting of sucrose, sorbitol, glycerol, potassium soap or mixtures thereof, or by the conversion of mechanical energy to heat energy, and wherein said soap is chipped, mixed, plodded, extruded, and stamped, the improvement comprising rendering said soap germicidal by the steps of:

i. preparing a visually clear solution of 1 part by weight of the germicide 2,4,4'-trichloro-2'-hydroxy diphenyl ether in about 0.7 to about 25 parts by weight of a liquid, pleasantly odorous substance, and ii. incorporating said visually clear solution into said soap prior to the completion of the plodding thereof, the proportions of said 2,4,4'-trichloro-2'-hydroxy diphenyl ether being from about 0.15% to about 6%, and the proportion of said solvent being from about 0.15% to about 4%, basis of said transparent soap bar.

2. In a process for preparing a transparent soap bar having a translucency voltage of no greater than about 35, said process comprising working below about 110°F. a toilet soap mass having a very low level of free alkali wherein the mechanical energy is converted into heat energy by working to an extent great enough to cause the mixture to rise in temperature to within a range of from about 100°F to about 110°F, the moisture and water-soluble, soap-compatible, alkali metal salt content having been adjusted prior to the end of the working step to lie within the combined areas "A" and "B" of the drawing hereof in the finished bar, and plodding the soap mass into bar form, the improvement comprising the steps of i. preparing a visually clear solution of 1 part by weight of 2,4,4'-trichloro-2'-hydroxy diphenyl ether in about 0.7 to about 25 parts by weight of a soap-compatible, liquid, pleasantly odorous solvent for said ether, and ii. incorporating said visually clear solution into said soap mass prior to the completion of the working thereof, the proportions of said 2,4,4'-trichloro-2'-hydroxy diphenyl ether being from about 0.15% to about 6%, and the proportion of said solvent being from about 0.15% to about 4%, basis of said transparent soap bar.

3. In a process for preparing a transparent soap bar wherein said transparency is achieved by a transparency aid selected from the group consisting of sucrose, sorbitol, glycerol, potassium soap or mixtures thereof, or wherein said transparency is achieved by working below about 110°F a toilet soap mass having a very low level of free alkali wherein the mechanical energy is converted into heat energy by working to an extent great enough to cause the mixture to rise in temperature to within a range of from about 100°F to about 110°F, the moisture and water-soluble, soap-compatible, alkali metal salt content having been adjusted prior to the end of the working step to lie within the combined Areas "A" and "B" of the drawing hereof in the finished bar, and wherein said soap is chipped, mixed, plodded, extruded, and stamped, the improvement comprising rendering said soap germicidal by the steps of:

i. preparing a visually clear solution of 1 part by weight of the germicide 2,4,4'-trichloro-2'-hydroxy diphenyl ether in about 0.7% to about 25 parts by weight of a liquid substance comprising a perfume ingredient selected from the group consisting of phenylethyl alcohol, benzyl alcohol, diphenyl ether, geraniol, linalyl acetate, irone, bergamot, lavandin, linalool, terpineol, and mixtures therof, and ii. incorporating said visually clear solution into said soap prior to the completion of the plodding thereof, the proportions of said 2,4,4'-trichloro-2'-hydroxy diphenyl ether being from about 0.15% to about 6%, and the proportion of said solvent being from about 0.15% to about 4%, basis of said transparent soap bar.

4. A solution comprising about 1 part by weight of 2,4,4'-trichloro-2'-hydroxy diphenyl ether and about 0.7 to about 25 parts by weight of a normally liquid perfume substance selected from the group consisting of phenylethyl alcohol, benzyl alcohol, diphenyl ether, geraniol linalyl acetate, irone, bergamot, lavandin, linalool, terpineol, and mixtures thereof, said solution being capable of imparting germicidal activity and a pleasing fragrance to a transparent soap with no adverse effect on the transparency thereof.

* * * * *